United States Patent [19]

Ito et al.

[11] Patent Number: 5,049,895

[45] Date of Patent: Sep. 17, 1991

[54] FLAT CIRCULAR WAVEGUIDE DEVICE

[76] Inventors: Yoshiharu Ito, No. 2-1, 2-Chome, Jin-nan, Shibuya-Ku, Tokyo; Kunitaka Arimura, No. 2-16, 2-Chome, Matsunami, Chigasaki-shi, Kanagawa-ken; Naohisa Goto, No. 6-15-1-A514, Tsuchihashi, Takatsu-ku, Kawasaki-shi, Kanagawa-ken, all of Japan

[21] Appl. No.: 694,411

[22] Filed: Jan. 24, 1985

[51] Int. Cl.[5] ..... H01Q 13/00

[52] U.S. Cl. ..... 343/785

[58] Field of Search ..... 343/770, 771, 785, 769

[56] References Cited

U.S. PATENT DOCUMENTS 2,929,064 3/1960 Kelly ..... 343/771
3,063,049 11/1962 Kelly ..... 343/771
3,220,007 11/1965 Thourel ..... 343/771
3,691,563 9/1972 Shelton ..... 343/771
4,242,685 12/1980 Sanford ..... 343/770

*Primary Examiner*—William L. Sikes
*Assistant Examiner*—Robert E. Wise
*Attorney, Agent, or Firm*—Bruce L. Adams; Van C. Wilks

[57] ABSTRACT

This invention provides a flat circular waveguide device which permits uniform radiation or power through a plurality of power-radiating openings in order to increase the antenna gain in the technical field of electric communications, especially, broadcasting antennas. To achieve such uniform radiation of power, the device is equipped with means for feeding power from a peripheral wall of a wave-guiding space, which is surrounded by metallic walls, toward a central part of the wave-guiding space.

26 Claims, 9 Drawing Sheets

FLAT CIRCULAR WAVEGUIDE DEVICE

BACKGROUND OF THE INVENTION

This invention relates to a flat circular waveguide (the so-called radial line type) device suitable for use as broadcasting antennas and the like.

A variety of flat circular waveguide devices has heretofore been proposed, including those having such a coaxial cable input structure as shown in FIG. 1 (indicated generally by a) and those having such a waveguide tube input structure as depicted in FIG. 2 (indicated as a whole by b). These conventional flat circular waveguide devices are accompanied by the following drawbacks irrespective of their structures:

(1) Power fed to a wave-guiding space c is subjected to attenuation to a considerable extent while it travels from the power-feeding portion to the terminal, as indicated by a solid line in FIG. 3 (The solid line corresponds to a flat circular waveguide device having slots d. The power density characteristic changes stepwise due to radiation lose through the slots d) and as indicated by a dashed line in FIG. 3 (the dashed line corresponds to a flat circular waveguide device having no slots are provided). Accordingly, the radiation power becomes uneven and the antenna gain is hence lowered significantly.

(2) A terminal resistor e (which is usually used for the distribution line type) is arranged along the periphery of the wave-guiding space c. This manner of arrangement requires use of the terminal resistor e which is elongated as a whole to cause a cost-up. Moreover, the size of the terminal resistor e must vary depending on the volume and size of the wave-guiding space c. Therefore, it is indispensable to provide terminal resistors of various sizes.

Incidentally, FIGS. 1 and 2 also illustrate an upper wall f formed of a metallic plate having the slots d therethrough, a lower wall g formed of a metallic plate, an inner conductor h1 of a coaxial cable, an outer conductor h2 of the coaxial cable, a waveguide i, a conductor matching plate j and an opening k.

SUMMARY OF THE INVENTION

In view of solving the above-mentioned various problems, an object of this invention is to provide a flat circular waveguide device which can concentrate power toward a central part of a wave-guiding space so as to achieve uniform power radiation through power-radiating openings (slots or slits) for a higher antenna gain and which also permits the size reduction and generalization of terminal resistors.

In accordance with one aspect of this invention, there is thus provided a flat circular waveguide device comprising:

a combination pair of metallic plates arranged in a face-to-face relation with an interval therebetween, one of said metallic plates having means defining a plurality of openings for radiation of power therethrough;

a peripheral metallic wall connecting the circumferences of the metallic plates to each other;

a wave-guiding space formed and surrounded by the metallic plates and peripheral wall; and means for feeding power to the wave-guiding space so that the power is concentrated from the peripheral metallic wall toward a central part of the internal wave-guiding space.

In a preferred embodiment of the flat circular waveguide device according to this invention, the power-feeding means is provided with a feed portion adapted to feed the power into the wave-guiding space and at least one intermediate metallic plate disposed in parallel with the metallic plates within the wave-guiding space with leaving a bypass gap between the intermediate metallic plate and the peripheral wall for passing the power therethrough.

In case the power is fed directly from the peripheral wall, it is not particularly necessary to provide such an intermediate metallic plate.

In another preferred embodiment of the flat circular waveguide device according to this invention, a terminal resistor is provided centrally within the wave-guiding space.

Accordingly, the flat circular waveguide device of this invention can bring about the following effects and merits:

(1) It permits uniform radiation of power and hence an improvement of the antenna gain. As a result, it is possible to make a highly-efficient antenna which may be successfully used as an antenna for satellite broadcasting and receiving.

(2) Since the terminal resistor can be arranged centrally within the wave-guiding space, it is possible to use a small and inexpensive terminal resistor. In addition, terminal resistors of the same size can be used irrespective of the diameters of flat circular waveguide devices. Therefore, the generalization of terminal resistors has been materialized.

(3) The major portion of the flat circular waveguide device has plane configurations. Owing to this shape, it is durable against snow and the like and may be successfully used as an unmanned receiving antenna for satellite broadcasting.

BRIEF DESCRIPTION OF THE DRAWINGS

FIG. 1 is a perspective view of one half of a flat circular waveguide device of a coaxial cable input type, showing the device in cross-section along the central axis thereof;

FIG. 2 is similar to FIG. 1 and illustrates a flat circular waveguide device of a waveguide tube input type;

FIG. 3 is a diagram showing the power density characteristic of the flat circular waveguide device of FIG. 1 or FIG. 2;

DETAILED DESCRIPTION OF THE PREFERRED EMBODIMENTS

A flat circular waveguide device of the coaxial cable input type according to one embodiment of this invention will hereinafter be described in conjunction with FIGS. 4 through 12 of the accompanying drawings.

Figure 1:
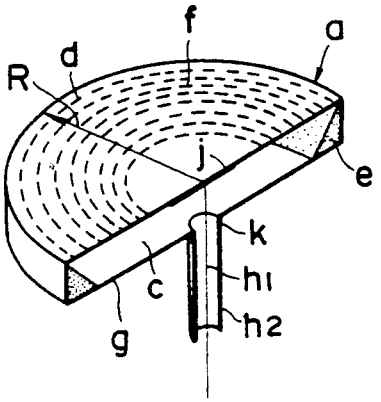
FIG. 1 PRIOR ART
FIGS. 1 through 3 relate to conventional flat circular waveguide devices, whereas FIGS. 4 through 18 pertain to the flat circular waveguide devices according to certain preferred embodiments of this invention, more specifically.
Figure 2:
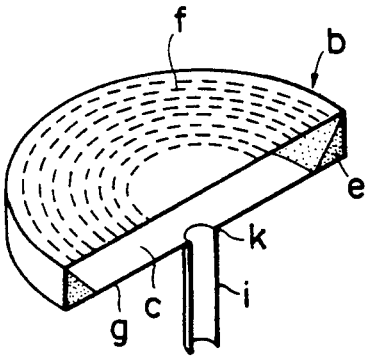
FIG. 2 PRIOR ART
Figure 3:
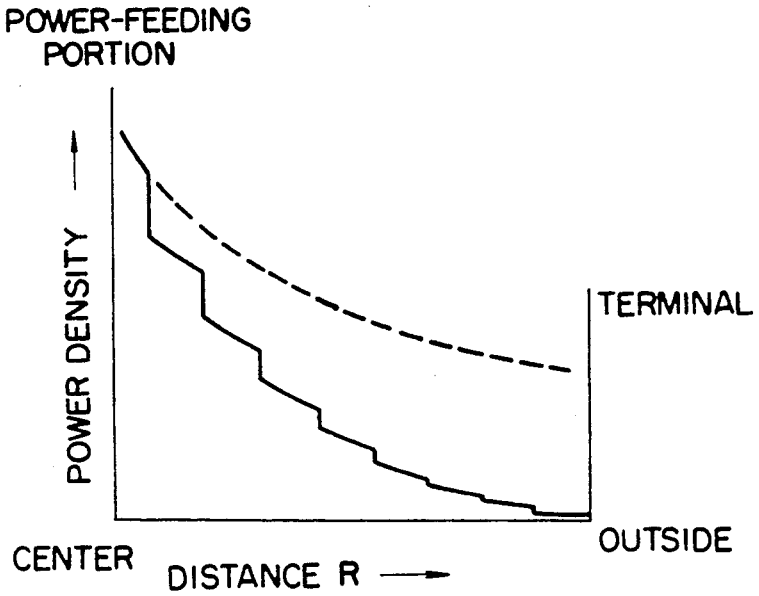
FIG. 3 PRIOR ART
Figure 4:
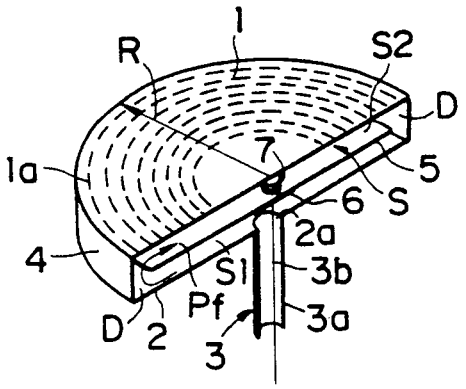
FIG. 4 is a perspective view of one half of the flat circular waveguide device according to one embodiment of this invention, depicting the device in cross-section along the central axis thereof.
Figure 5:
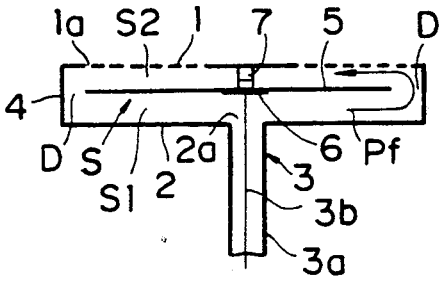
FIG. 5 is a cross-sectional view of the flat circular waveguide device of FIG. 4, taken along the central axis thereof.
Figure 6:
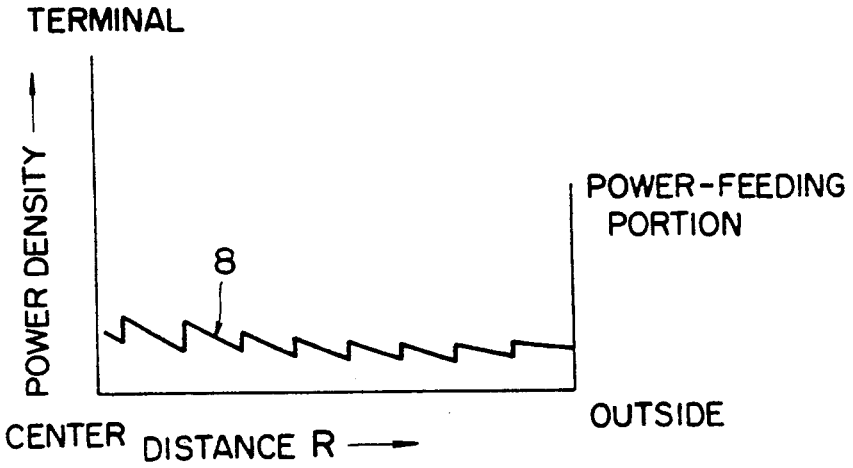
FIG. 6 is a diagram showing the power density characteristic of the flat circular waveguide device of FIG. 4.

As seen in FIGS. 4 and 5, top and bottom metal disks or plates 1 and 2 are arranged in combination so that they face each other with leaving an interval therebetween. One of the metal disks, namely, the top metal disk 1 has a plurality of slots (or slits) 1*a* disposed along concentric circles, a spiral of Archimedes or the like as power-radiating openings.

On the other or bottom hand, the other metal disk 2 has an opening 2*a* connected to a coaxial cable 3 which serves as a power-feeding or input portion.

A metal-made peripheral or annular wall 4 is also provided to connect the peripheries of these metallic disks 1 and 2 together. A wave-guiding space S is formed and surrounded by these metallic disks 1 and 2 and metal-made peripheral wall 4.

In addition, an intermediate metallic plate 5 is disposed in parallel with the metallic disks 1 and 2 within the wave-guiding space S in such a manner that a bypass gap or passage D is left between the intermediate metallic plate 5 and peripheral wall 4 for passing a power wave. Therefore, the wave-guiding space S is divided by the intermediate metallic plate 5 into two upper and lower wave-guiding compartments S1 and S2.

By the way, this intermediate metallic plate 5 is attacked for example to the peripheral wall 4 by way of an insulation material or to the metallic disks 1 and/or 2 by way of an insulating disk or the like. Several attachment points are suitably chosen for the intermediate metallic plate 5.

The coaxial cable 3 is connected, as mentioned above, to the opening 2*a* of bottom metallic disk 2. This connection is made in the following manner. Namely, an outer conductor 3*a* of the coaxial cable 3 is connected to the opening 2*a*, whereas an inner conductor 3*b* of the coaxial cable 3 is connected to a conductor-matching plate 6 attached to the lower surface of the intermediate metallic plate 5.

As indicated by an arrow Pf, power or a power wave which has been fed to the lower wave-guiding compartment S1 travels through the lower wave-guiding compartment S1 and via the gap or passage D provided between the peripheral wall 4 and intermediate metallic plate 5, enters the upper wave-guiding compartment S2 and then passes or travels toward a central part of the upper wave-guiding compartment S2. Thus, power-feeding means for guiding the power fed from the peripheral part of the wave guiding spaces to the central part of the internal wave-guiding space S is constructed at first by the coaxial cable 3 and next by the bypass gap D provided between the plate 5 and the peripheral wall 4.

While the fed power or power wave passes through the upper wave-guiding compartment S2, the power is radiated through the slots 1*a* formed on the metallic disk 1. Resulting power density characteristic of the radiation is indicated by a line 8 in FIG. 6. The characteristic line 8 has a saw-toothed shape, because the power density drops abruptly when the power is radiated through the slots 1*a*. It is, however, envisaged that the overall level of the characteristic line S remains substantially flat irrespective of the distance R from the terminal. Consequently, the flat circular waveguide device of this invention features the substantially uniform radiation of power, leading to a significant improvement of the antenna gain.

Figure 7:
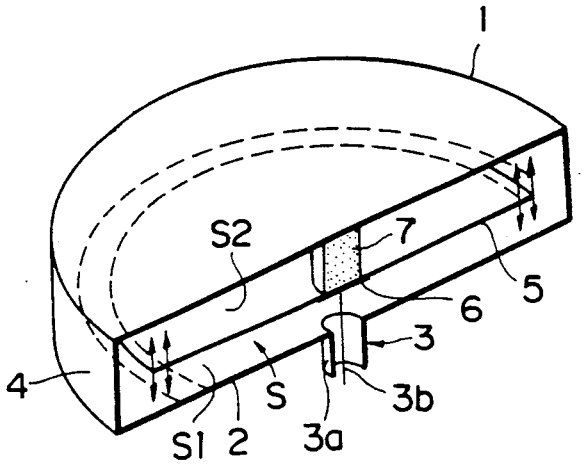
FIG. 7 is a simplified schematic illustration of the flat circular waveguide device of FIG. 4, showing the function of the device.

Here, the state of the electric field and magnetic field of the power in the wave-guiding space S is illustrated as shown in FIG. 7, in which the direction of the electric field is indicated by arrows whereas the distribution of the magnetic field is indicated by broken lines. It should be borne in mind that the slots 1*a* are omitted in FIG. 7 for abbreviation.

A terminal resistor 7 is also arranged centrally within the upper wave-guiding compartment S2. Any remaining amounts of the fed power which have reached the central terminal portion are consumed or absorbed by the terminal resistor 7. Since the terminal resistor 7 is provided centrally within the upper wave-guiding compartment S2, it is possible to use a resistor having a short peripheral length. This permits a cost reduction. Besides, terminal resistors of the same size may be applied to flat circular waveguide devices of different sizes because it is unnecessary to change the size of the terminal resistor 7 in accordance with the sizes of the metallic disks 1 and 2.

Figure 8:
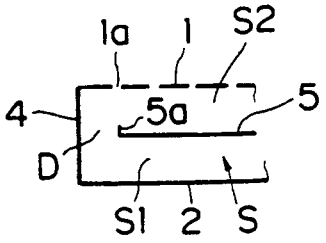
FIG. 8 is a fragmentary, central, cross-sectional view of a modification of the flat circular waveguide device of FIG. 4.

By the way, the matching of the two wave-guiding compartments S1 and S2 may be achieved, for example, by adjusting the shape of the gap D or as illustrated in FIG. 8, by forming an upright adjustment wall 5*a* at the periphery of the intermediate metallic plate 5.

Figure 9:
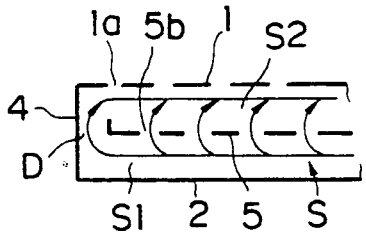
FIG. 9 is a fragmentary, central, cross-sectional view of another modification of the flat circular waveguide device of FIG. 4.

Reference may next be made to FIG. 9, in which through-holes in the form of slits or perforations 5*b* are formed through the intermediate metallic plate 5 as coupling holes for the wave-guiding compartments S1 and S2. These slits or perforations 5*b* are effective for controlling the power density in the upper wave-guiding compartment S2 or for changing the polarization. Although the drawing shows many slits or perforations, the number of such slits or perforations is suitably chosen provided that their shapes, size and distribution are taken into consideration. In a typical case, it is feasible to form only one annular slit or perforation through the intermediate metallic plate 5.

Figure 10:
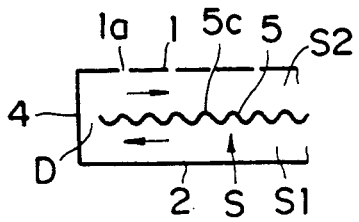
FIG. 10 is a fragmentary, central, cross-sectional view of a further modification of the flat circular waveguide device of FIG. 4.

It is also possible to make the intermediate metallic plate 5 and/or lower metallic plate 2 to form a concentric wavy surface (corrugated surface) 5*c* as shown in FIG. 10 thereby permitting the control of the propagation constant and hence improving the antenna directivity and gain. Either one side or both sides of the intermediate metallic plate 5 or lower metallic plate 2 is formed into such a wavy surface or surfaces. Or a low loss insulator may be used for the same purposes.

Figure 11:
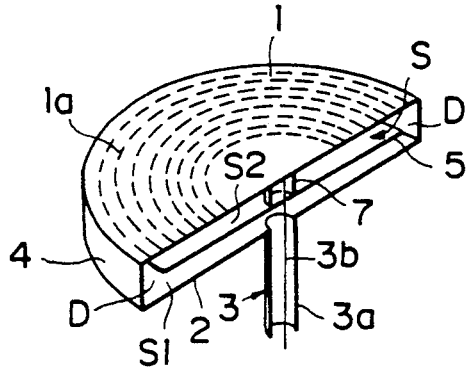
FIG. 11 is a perspective view of one half of a further modification of the flat circular waveguide device of FIG. 4, depicting the device in cross-section along the central axis thereof.

As shown in FIG. 11, the terminal resistor 7 is formed as a cylindrical wall composed of a thin film of a resistant material, for example, carbon. The resistance of the terminal resistor 7 is matched with the impedance of the coaxial cable 3 by short-circuiting a central part of the cylindrical terminal resistor 7 to the inner conductor 3*b* of the coaxial cable 3 and setting the radius of the transverse cross-sectional area of the cylindrical terminal resistor 7 at a quarter of the line of the coaxial cables. In this manner, a reflection-free terminal resistor can be materialized.

Figure 12:
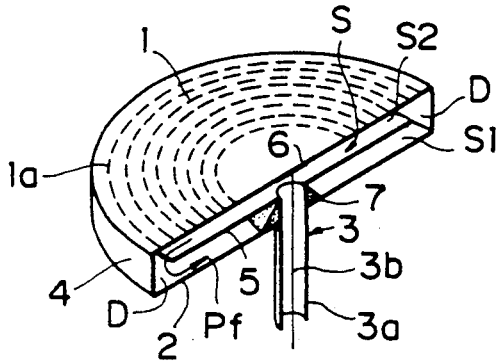
FIG. 12 is a perspective view of one half of a further modification of the flat circular waveguide device of FIG. 4, depicting the device in cross-section along the central axis thereof.

Reference may next be made to FIG. 12, in which the coaxial cable 3 is connected to the upper wave-guiding compartment S2 whereas the terminal resistor 7 is provided centrally within the lower wave-guiding compartment S1. This arrangement permits use of a terminal resistor having a short peripheral length. This arrangement can thus improve the generalization of terminal resistors. In the illustrated embodiment, the side wall of the terminal resistor 7 is formed into a tapered surface.

Figure 13:
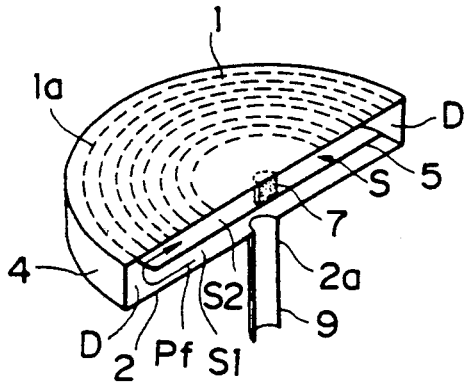
FIG. 13 is a perspective view of one half of the flat circular waveguide device of the waveguide tube input type according to a still further embodiment of this invention, showing the device in cross-section along the central axis thereof.
Figure 14:
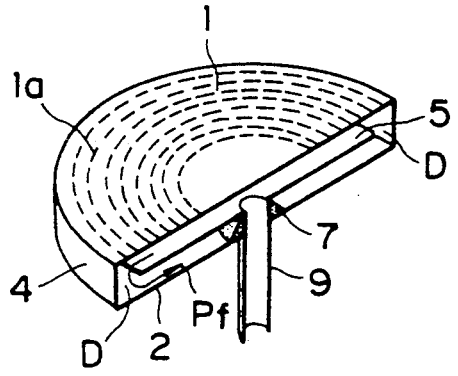
FIG. 14 is a perspective view of one half of a modification of the flat circular waveguide device of FIG. 13, depicting the device in cross-section along the central axis thereof.

FIGS. 13 and 14 show flat circular waveguide devices of the waveguide tube input type as further embodiment of this invention. FIG. 13 is a perspective view of one half of the flat circular waveguide device, illustrating the device in cross-section along the central axis thereof. FIG. 14 is similar to FIG. 13 and a modification of the device of FIG. 13 is shown there. In FIGS. 13 and 14, the same reference numerals and letters as those employed in FIGS. 4–12 identify substantially like elements of the structure.

In this embodiment, a waveguide tube 9 is connected as power-feeding or input means instead of the coaxial cable 3 in the former embodiments. The device of FIG. 13 is equipped with a terminal resistor 7 arranged centrally within the upper wave-guiding compartment S2. Therefore, it corresponds to the device depicted in FIG. 4.

On the other hand, the device of FIG. 14 includes a terminal resistor 7 having a tapered side surface and arranged centrally within the lower wave-guiding compartment S1. Thus, this device corresponds to the device illustrated in FIG. 12.

These embodiments can bring about substantially the same effects and merits as the former embodiments of modifications. It is of course possible to shape the intermediate metallic plate 5 in such a manner as shown in FIGS. 9 and 10. It is also feasible to form the terminal resistor 7 into such a shape as depicted in FIG. 11. By doing so, their respective effects or merits can be obtained.

In case that the fed power becomes very small at the central terminal, the terminal resistor 7 may be omitted without causing any problem or inconvenience upon actual application thereof.

In each of the above embodiments or modifications, a plurality of intermediate metallic plates, each similar to the intermediate metallic plate 5, may be space apart with each other and disposed in parallel with the metallic disks 1 and 2.

Besides, the side wall of the terminal resistor 7 arranged in the upper wave-guiding compartment S2 may be formed into a tapered surface.

Figure 15:
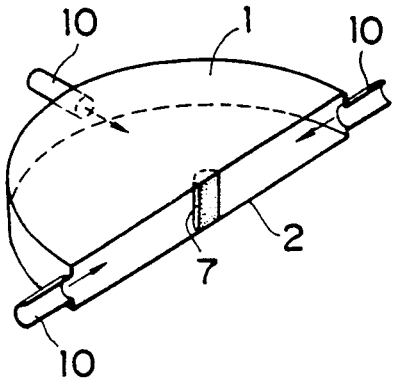
FIG. 15 is a perspective view of one half of the flat circular waveguide device according to a still further embodiment of this invention, showing the device in cross-section along the central axis thereof.
Figure 16:
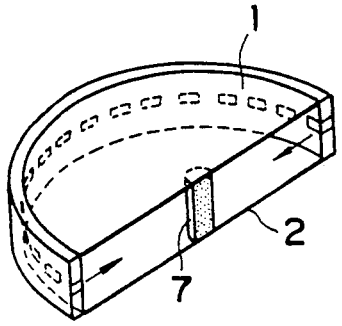
FIG. 16 is a perspective view of one half of the flat circular waveguide device according to a still further embodiment of this invention, showing the device in cross-section along the central axis thereof.
Figure 17A:
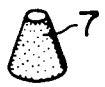
FIGS. 17(*a*) through 17(*g*) show examples of the terminal resistor respectively.
Figure 17B:
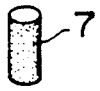
Figure 17C:
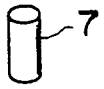
Figure 17D:
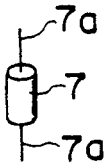
Figure 17E:
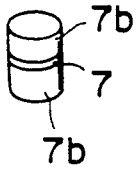
Figure 17F:
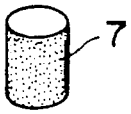
Figure 17G:
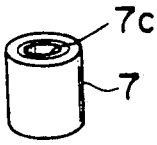

It is also feasible to supply power directly through the peripheral or annular wall without using the intermediate metallic plate or plates. For example, power is fed through the peripheral wall by means of a plurality of feed lines as shown in FIG. 15. Alternatively, a waveguide tube or coaxial cable is formed into a circular shape along the periphery of the device as depicted in FIG. 16 so that the power is supplied from the peripheral portion of the wave-guiding space through the circular waveguide tube or coaxial cable. By the way, FIG. 15 and 16 omit the slots 1*a* formed through the metallic disk 1.

In the embodiments shown in FIGS. 15 and 16, a terminal resistor 7 is also disposed centrally. Examples of such a terminal resistor are shown in FIGS. 17(*a*) to 17(*g*).

Namely, FIG. 17(*a*) shows a tapered or frustoconical solid terminal resistor while FIG. 17(*b*) illustrates a cylindrical solid terminal resistor. The terminal resistor of FIG. 17(*c*) is also cylindrical but is formed of a cylinder of a ceramic material or the like and a thin film is applied thereon. FIG. 17(*d*) illustrates a conventional solid or thin-film resistor equipped with metallic leads 7*a*. FIG. 17(*e*) depicts a disk-shaped terminal resistor, which is sandwiched between upper and lower metal pieces 7*b*. On the other hand, FIG. 17(*f*) shows a terminal resistor formed of a thin film so that the terminal resistor can be used as a terminal resistor of $\frac{1}{4}$ wavelength. FIG. 17(*g*) shows a tube-shaped terminal resistor formed of, for example, ferrite and applied metallic layer on its inner wall.

Figure 18:
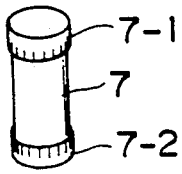
FIG. 18 illustrates a still further example of the terminal resistor.

Reference is next made to FIG. 18 which illustrates by way of example the actual structure of attachment of the resistor. In the drawing, numerals 7-1 and 7-2 designate respectively metal cups having narrow slits in their peripheral walls. Due to the spring effects of these narrow slits, upper and lower portions of the resistor 7 are fit firmly in their corresponding metal cups to ensure perfect electrical connection therebetween.

The leads 7*a*, metal pieces 7*b* and/or metal cups 7-1 and 7-2 may be connected by screws directly to the top and bottom disks and the intermediate plate or may be welded directly thereto.

What is claimed is:

1. A flat circular waveguide device comprising:

a pair of metallic plates arranged in a face-to-face relation with an interval therebetween, one of said metallic plates having means defining a plurality of openings for radiation of a power wave therethrough;

a peripheral metallic wall connecting the circumferences of the metallic plates with each other to define a flat cylinder;

means defining a wave-guiding space inside of the flat cylinder and dimensioned to allow a power wave to travel through the wave-guiding space; and means for feeding a power wave to the wave-guiding space so that the power wave is guided through the wave-guiding space to travel from a circumferential part of the wave-guiding space near the peripheral metallic wall toward a central part of the wave-guiding space, the means being comprised of a feed portion through which the power wave is fed into the wave-guiding space, at least one intermediate metallic plate between said feed portion and said openings and attached to said flat cylinder by way of a spacer and disposed substantially in parallel with the metallic plates within the wave-guiding space, and means defining a bypass gap between the intermediate metallic plate and the peripheral metallic wall for guiding the power wave.

2. A flat circular waveguide device as claimed in claim 1, wherein the intermediate metallic plate defines two wave-guiding compartments within the wave-guiding space divided thereby and has means defining at least one hole for coupling the two wave-guiding compartments.

3. A flat circular waveguide device as claimed in claim 2, wherein the intermediate metallic plate has means defining a plurality of holes for coupling the two wave-guiding compartments with each other.

4. A flat circular waveguide device as claimed in claim 1, wherein at least one side of the intermediate metallic plate has means defining a corrugated surface.

5. A flat circular waveguide device as claimed in claim 1, wherein the plurality of power-radiating openings are distributed substantially evenly along the metallic plates.

6. A flat circular waveguide device comprising:

a pair of metallic plates arranged in a face-to-face relation with an interval therebetween, one of said metallic plates has means defining a plurality of openings for radiation of a power wave therethrough;

a peripheral metallic wall connecting the circumferences of the metallic plates with each other to define a flat cylinder;

means defining a wave-guiding space inside of the flat cylinder and dimensioned to allow a power wave to travel through the wave-guiding space;

means for feeding a power wave to the wave-guiding space so that the power wave is guided through the wave-guiding space to travel from a circumferential part of the wave-guiding space near the peripheral metallic wall toward a central part of the wave-guiding space; and a terminal resistor provided at the central part of the wave-guiding space.

7. A flat circular waveguide device as claimed in claim 6, wherein a side wall of the terminal resistor has a tapered surface.

8. A flat circular waveguide device as claimed in claim 6, wherein the means for feeding a power wave includes a coaxial cable having a central conductor, and the terminal resistor comprises a cylindrical wall composed of a thin film of a resistant material, a central part of the cylindrical wall being short-circuited to the central conductor of the coaxial cable, and the radius of the transverse cross-sectional area of the cylindrical wall being set at a quarter of a line wavelength of the coaxial cable.

9. A flat circular waveguide device as claimed in claim 6, wherein the terminal resistor comprises a tube provided with a metallic layer on its inner wall.

10. A flat cylinder waveguide device comprising: a top metal disk having means defining a plurality of openings disposed along concentric circles thereon for outwardly radiating a power wave; a bottom metal disk spaced apart from the top metal disk; an annular metal wall disposed between the circumferences of the top and bottom metal disks to define a wave-guiding space surrounded by the top and bottom metal disks and the annular metal wall and dimensioned to allow a power wave to travel through the wave-guiding space, the wave-guiding space having a central portion and a peripheral portion; input means communicating with the wave-guiding space for supplying a power wave into the wave-guiding space; and guiding means provided in the wave-guiding space for guiding the power wave supplied into the wave-guiding space to allow the power wave to travel from the wave-guiding space peripheral portion to the wave-guiding space central portion along the top metal disk so that the power wave is radiated from the openings during the travel thereof to attain a substantially uniform radiation of the power wave.

11. A flat circular waveguide device as claimed in claim 10; wherein the input means is connected to the center of the bottom metal disk for supplying the power wave at the central portion of the wave-guiding space; and the guiding means includes an intermediate metal plate disposed between the top and bottom metal disks to define an upper wave-guiding compartment between the top metal disk and the intermediate metal plate and a lower wave-guiding compartment between the bottom metal disk and the intermediate metal plate, the intermediate metal plate being spaced apart from the annular metal wall to define a passage therebetween for connecting the upper and lower wave-guiding compartments at the peripheral portion of the wave-guiding space so that the lower wave-guiding compartment guides therethough the power wave supplied in the central portion to travel toward the peripheral portion and the upper wave-guiding compartment guides therethough the power wave passing through the passage to travel toward the central portion along the top metal disk.

12. A flat circular waveguide device as claimed in claim 11; wherein the input means comprises a coaxial cable.

13. A flat circular waveguide device as claimed in claim 11; wherein the input means comprises a waveguide tube.

14. A flat circular waveguide device as claimed in claim 11; wherein the intermediate metal plate has an upright adjustment wall portion provided on a peripheral portion of the intermediate metallic plate for matching the upper and lower wave-guiding compartments.

15. A flat circular waveguide device as claimed in claim 11; wherein the intermediate metal plate has means defining a through-hole therein for coupling the upper and lower wave-guiding compartments.

16. A flat circular waveguide device as claimed in claim 11; wherein the intermediate metal plate has a corrugated surface.

17. A flat circular waveguide device as claimed in claim 10; including a terminal resistor disposed at the central portion of the wave-guiding space for absorbing the power wave traveling from the peripheral portion to the central portion.

18. A flat circular waveguide device as claimed in claim 17; wherein the terminal resistor has a frustoconical shape.

19. A flat circular waveguide device as claimed in claim 17; wherein the terminal resistor has a cylindrical shaped.

20. A flat circular waveguide device as claimed in claim 17; wherein the terminal resistor comprises a tube having metallic layer on an inner surface thereof.

21. A flat circular waveguide device as claimed in claim 17; wherein the input means comprises a coaxial cable connected to the center of the bottom metal plate and having an outer conductor and an inner conductor.

22. A flat circular waveguide device as claimed in claim 21; wherein the terminal resistor comprises a cylindrical wall composed of a resistant material, a central part of the cylindrical wall being short-circuited to the inner conductor, and the radius of the cylindrical wall being a quarter of a line wavelength of the coaxial cable.

23. A flat circular waveguide device as claimed in claim 10; wherein the input means comprises a plurality of wave-guide tubes arranged on the annular metal wall at a certain angular interval from one another; and the guiding means comprises the wave-guiding space.

24. A flat circular waveguide device as claimed in claim 10; wherein the input means comprises a coaxial cable.

25. A flat circular waveguide device as claimed in claim 10; wherein the input means comprises a wave-guide tube.

26. A flat cylinder waveguide device comprising:

a top metal disc having means defining a plurality of openings disposed along a spiral of Archimedes thereon for outwardly radiating a power guide;

a bottom metal disc spaced apart from the top metal disc;

an annular metal wall disposed between the circumferences of the top and bottom metal discs to define a wave guiding space surrounded by the top and bottom metal discs and the annular metal wall and dimensioned to allow a power wave to travel through the wave guiding space, the wave guiding space having a central portion and a peripheral portion;

input means communicating with the wave guiding space for supplying a power wave into the wave guiding space; and guiding means provided in the wave guiding space for guiding the power wave supplied into the wave guiding space to allow the power wave to travel from the wave guiding space peripheral portion to the wave guiding space central portion along the top metal disc so that the power wave is radiated from the openings during the travel thereof to obtain a substantially uniform radiation of the power wave.

* * * * *